US005276491A

United States Patent [19]

Fuma et al.

[11] Patent Number: 5,276,491

[45] Date of Patent: Jan. 4, 1994

[54] IMAGE FORMING APPARATUS

[75] Inventors: Hiroshi Fuma; Mitsuo Motohashi; Yozo Fujii; Akihiko Kakita, all of Hachioji, Japan

[73] Assignee: Konica Corporation, Japan

[21] Appl. No.: 809,022

[22] Filed: Dec. 16, 1991

Related U.S. Application Data

[63] Continuation of Ser. No. 621,851, Dec. 4, 1990, abandoned.

[30] Foreign Application Priority Data

| | | | |
|---|---|---|---|
| Dec. 6, 1989 | [JP] | Japan | 1-317061 |
| Dec. 6, 1989 | [JP] | Japan | 1-317063 |
| Dec. 6, 1989 | [JP] | Japan | 1-317063 |
| Dec. 7, 1989 | [JP] | Japan | 1-318509 |
| Dec. 11, 1989 | [JP] | Japan | 1-310937 |

[51] Int. Cl.[5] ..... G03G 15/16

[52] U.S. Cl. ..... 355/275; 355/218; 355/274; 355/281

[58] Field of Search ..... 355/216, 218, 271, 273, 355/274, 275, 280, 281, 317, 326

[56] References Cited

U.S. PATENT DOCUMENTS

| | | | |
|---|---|---|---|
| 3,357,325 | 12/1967 | Eichorn et al. | 355/274 |
| 4,553,149 | 11/1985 | Yano | 346/153.1 |
| 4,816,867 | 3/1989 | Ito | 355/218 |
| 4,905,048 | 2/1990 | Suzuki | 355/271 |
| 4,958,194 | 9/1990 | Kaieda et al. | 355/277 |

FOREIGN PATENT DOCUMENTS

| | | |
|---|---|---|
| 24154 | 2/1981 | European Pat. Off. . |
| 385674 | 9/1990 | European Pat. Off. . |

OTHER PUBLICATIONS

Patent Abstracts of Japan, vol. 8, No. (E-279) (1687); Nov. 16, 1984 JPA-59-126366; Jul. 20, 1984.

*Primary Examiner*—Leo P. Picard
*Assistant Examiner*—Christopher Horgan
*Attorney, Agent, or Firm*—Jordan B. Bierman

[57] ABSTRACT

An image forming apparatus for forming a toner image on a peripheral surface of an image carrying drum and transferring the toner image onto a recording paper. The image forming apparatus comprises a conveyor to convey the recording paper, a register roller to feed the same to the conveyor, transfer unit for transfering the toner image and a pre-charging unit for charging the recording paper before the transferring. A controller of the image forming apparatus controls operation timings of the above units of the image forming apparatus and forms a blank area in the leading portion of the recording paper where no image is formed and no transfer operation is performed to the recording paper by the transfer unit.

7 Claims, 14 Drawing Sheets

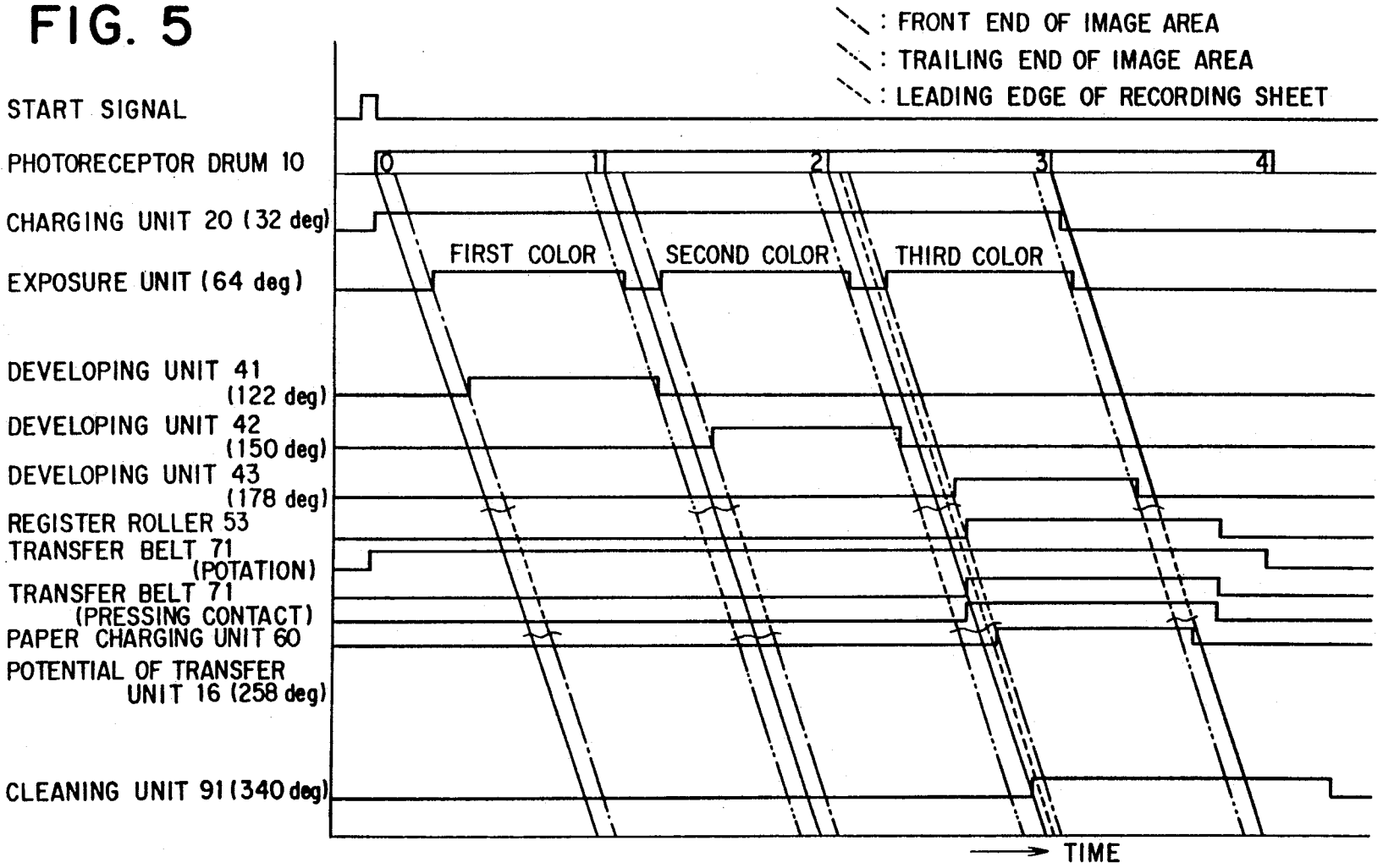
FIG. 5
START SIGNAL
PHOTORECEPTOR DRUM 10
CHARGING UNIT 20 (32 deg)
EXPOSURE UNIT (64 deg)
DEVELOPING UNIT 41 (122 deg)
DEVELOPING UNIT 42 (150 deg)
DEVELOPING UNIT 43 (178 deg)
REGISTER ROLLER 53
TRANSFER BELT 71 (ROTATION)
TRANSFER BELT 71 (PRESSING CONTACT)
PAPER CHARGING UNIT 60
POTENTIAL OF TRANSFER UNIT 16 (258 deg)
CLEANING UNIT 91 (340 deg)
FIRST COLOR
SECOND COLOR
THIRD COLOR
0
1
2
3
4
: FRONT END OF IMAGE AREA
: TRAILING END OF IMAGE AREA
: LEADING EDGE OF RECORDING SHEET
TIME

IMAGE FORMING APPARATUS

This application is a continuation of application number 07/621,851 filed Dec. 4, 1990, now abandoned.

BACKGROUND OF THE INVENTION

The present invention relates to an image forming apparatus such as an electrostatic copier provided with a transfer belt unit which supports and conveys a transfer sheet electrostatically, transfers a toner image formed on an image carrier onto the transfer sheet, and conveys the transfer sheet to a fixing means.

DESCRIPTION OF THE PRIOR ART

FIG. 8 is a cross section of an example of a conventional electrostatic copier. In FIG. 8, the numeral 10 is a photoreceptor drum, which is a drum-shaped image carrier. The numeral 20 is a charger which charges the circumferential surface of the photoreceptor drum 10. The numeral 30 is an exposure unit. The numeral 13 is an image exposure unit. The numeral 40 is a developing unit. The numeral 50 is a transfer sheet supply unit. The numeral 53 is a paper feed roller. P represents a recording paper which is used as a transfer sheet. The numeral 16 is a transfer unit which is a charger used for transfer. The numeral 17 is a separator which uses a discharger for separation. The numeral 80 is a fixing unit. The numeral 90 is a cleaning unit. The numeral 56 is a conveyance belt which conveys recording paper P.

The motions of the above-described copier will be explained as follows. After the circumferential surface of the photoreceptor drum 10 has been uniformly charged, it is exposed by the exposure unit 30 so that a latent image can be formed electrostatically. After that, the above-described latent image is changed into a toner image by the developing unit 40. This toner image is transferred onto recording paper P which is conveyed by the paper feed roller 53 of the paper feed unit 50 synchronously with the rotation of the photoreceptor drum 10. Recording paper P is charged by the transfer unit 16 to the polarity reverse to the above-described toner so that the toner image on the photoreceptor drum 10 can be transferred onto recording paper P. After image transfer, high A.C voltage is impressed upon recording paper P by the separator 17 so that recording paper P can be discharged and separated from the surface of the photoreceptor drum 10. Separated recording paper P is conveyed to the fixing unit 80 by the conveyance belt 56, and the toner image is fixed. After that, recording paper P is delivered onto a delivery tray placed outside the apparatus.

After the toner image has been transferred from the photoreceptor 10 surface onto recording paper P, the residual toner on the photoreceptor surface is cleaned by the cleaning unit 90 so as to be prepared for the following copying operation.

However, in the case of the electrostatic copier described above, in order to improve the transferability and separability of the toner image, the discharge efficiency between the transfer unit 16 and the separator 17 must be adjusted so that they can function in the best condition. This discharge efficiency is greatly influenced by environmental factors, so that the allowable range of the discharge efficiency is narrow to maintain high reliability. The above-described transferability is influenced by the electric charge and mechanical properties of transfer paper P such as stiffness, surface smoothness, and curl. These factors fluctuate greatly due to the preservation state of recording paper P and the environmental conditions such as temperature and humidity, so that it is difficult to maintain the best condition.

When the diameter of the photoreceptor drum 10 is large, the unwinding force of recording paper P which has been wound around the photoreceptor drum 10 is smaller than recording paper P wound around the photoreceptor drum of a small diameter. Accordingly, recording paper P onto which a toner image has been transferred is liable to stick to the photoreceptor 10 drum surface, so that a paper jam is caused and the papering efficiency is lowered resulting in a deterioration of the reliability.

In order to solve the problems described above, a belt-shaped transfer and conveyance unit illustrated in FIG. 9 has been disclosed in the official gazette of U.S. Pat. No. 3,357,325.

In FIG. 9, the numeral 10 is a photoreceptor drum which is a drum-shaped image carrier. The numeral **70*a* is a transfer belt unit which is a belt-shaped transfer and conveyance unit. The numeral 71 is a transfer belt which is composed of a monolayer dielectric belt. The numerals 72,73 are rollers between which the transfer belt 71 is stretched and by which the transfer belt 71 is driven. The numeral 60 is a pre-transfer charger which conducts corona discharge in order to attract recording paper P to the surface of the transfer belt 71 by electrostatic force. The numeral 16 is a transfer charger which transfers a toner image from the photoreceptor drum 10 onto recording paper P. The numeral 160 is a transfer location. Since the apparatus is composed in such a way as described above, recording paper P fed by the paper feed roller 53 can be tightly stuck to the surface of the transfer belt 71** so that it can be positively conveyed, and the transfer efficiency and separation efficiency can be improved.

The above-described transfer belt unit **70*a* is preferable in the case of a color image forming apparatus in which toner images are registered on the photoreceptor drum 10** and they are transferred onto recording paper P at the same time.

The transfer belt unit is superior to the photoreceptor drum unit from the following two viewpoints: in the case of the above-described color image forming apparatus illustrated in FIG. 8, since a plurality of toner images are registered on the photoreceptor drum 10, a plurality of developing units must be provided around the photoreceptor drum 10, so that the photoreceptor drum of a large diameter is necessary and the conventional electrostatic transfer separation system is not sufficient to separate recording paper P from the photoreceptor drum 10; and when a plurality of toner images are registered, a large amount of toner is adhered to the surface, so that a large electric charge is necessary for transfer, wherein the transfer belt unit in the color image forming apparatus illustrated in FIG. 9 can hold a large electric charge.

In the transfer belt unit illustrated in FIG. 9, recording paper P is charged by the pre-transfer charger 60, and at the same time the transfer belt 71 is charged to the reverse polarity, so that recording paper P and the transfer belt 71 attract each other, and when the transfer belt 71 is moved, recording paper P is conveyed. However, when transfer charge is conducted in order to transfer a toner image onto recording paper P, the attraction force is weakened, so that the separability of recording paper from the photoreceptor drum 10 is deteriorated.

The first object of the present invention is to provide an image forming apparatus in which the above-described problems can be solved, the leading portion of an image can be clearly copied and further the separability of recording paper from the photoreceptor drum is improved.

Pre-transfer charging has a disadvantage in that: ozone is generated, and dust adheres to the wires of the charger in corona discharge conducted by the pre-transfer charger, so that unevenness of discharge due to the adhering dust is increased. In spite of the disadvantage described above, pre-transfer charging is conducted in the transfer and conveyance apparatus for the purpose of improving the separability of transfer paper. However, it is pre-transfer charging of the leading edge of the transfer paper that contributes to an improvement in separability and not pre-charging of other portions of the transfer paper.

The second object of the present invention is to provide a transfer and conveyance apparatus in which unevenness of discharge due to dust adhered to the wires of the pre-transfer charger can be decreased, and further the transfer paper can be positively separated from the photoreceptor drum.

In the transfer and conveyance unit (the transfer belt unit) illustrated in FIG. 9, there is caused such a problem that: when the transfer belt 71 is released from the press-contact with the photoreceptor drum 10 in the condition that a certain amount of electric charge is existing on the transfer belt 71 (approximately not less than $5\times10^{-5}c/m^2$), the electric potential of the transfer belt 71 is abruptly increased, so that a spark will be generated between the transfer belt 71 and the circumferential surface of the photoreceptor drum 10, resulting in damage of the photoreceptor layer of the photoreceptor drum 10.

The third object of the present invention is to solve the problems described above, and to provide an image forming apparatus in which the above-described damage of the photoreceptor layer can be prevented.

SUMMARY OF THE INVENTION

The above-described first object of the present invention can be accomplished by an image forming apparatus in which a developed toner image on an image carrier is transferred onto a recording paper by a transfer unit with a rotating transfer belt, and which image forming apparatus is characterized in that: the recording paper is charged by a transfer unit so that a non-transfer area can be provided at the leading edge portion of the recording paper; and the optical scanning starting point, the scanner reading-out starting point, or the printer writing-in starting point is set so that the leading edge of the image can be placed after the above-described non-transfer area.

However, concerning the setting of the above-described non-transfer area, there are caused the following problems.

FIG. 12 is a schematic illustration showing the electric field strength of transfer which is formed by the conventional transfer unit 161 illustrated in FIG. 19 and FIG. 20. In the drawings, the numeral 161 is a shield member composed of an aluminum plate, a stainless plate, and a surface treated steel sheet. The numeral 162 is a discharge electrode made from a thin tungsten wire. The numeral 16 in FIG. 19 is a transfer unit having a wide opening of the shield member 161, and the numeral 16 in FIG. 20 is a transfer unit having a narrow opening of the shield member 161. E is the electric field strength of transfer which is formed by the transfer unit 16.

As illustrated in FIG. 19 and FIG. 20, in the case of the conventional transfer unit 16, its electric field strength is widely spread, so that the electric field of transfer rises gently at the boundary between the non-transfer area and the transfer area, which results in the generation of an area in which rising-up transferability is not sufficient. Consequently, a problem is caused in that the above-described non-image area must be extended, so that the image area must be reduced.

In the case of the conventional transfer unit 16 illustrated in FIG. 19 and FIG. 20, there is a problem in that transfer is accompanied by corona discharge, so that the life of the transfer belt 71 is shortened and further the corona discharge is harmful to operators.

The above-described problems can be solved by an image forming apparatus in which a transfer belt stretched between rollers is used, and a toner image on an image carrier is transferred onto a transfer sheet at the transfer unit, and which is characterized in that: a conductive roller and a transfer bias roller upon which transfer bias can be impressed come into contact with the rear side of the transfer belt so that a predetermined leading edge portion can become a non-transfer area; and the above-described transfer bias is impressed upon other portions so that the toner image can be transferred onto the transfer sheet.

When the above-described non-transfer area is set, the paper feed timing must be highly accurate. However, in the conventional image forming apparatus, the leading edge positions of recording papers P are not aligned due to the fluctuation of the rotation starting time of the paper feed roller 53, the slip of the paper feed roller 53, and the difference in size and thickness of recording papers P. Accordingly, it is necessary to widen the above-described non-transfer area. In this case, there is a problem in that the non-transfer areas of recording papers P fluctuate.

The above-described problem can be solved by an image forming apparatus in which a toner image formed on an image carrier is transferred onto a recording paper which has been fed by a paper feed roller, and which is characterized in that: a recording paper detecting means is provided on a paper feed path between the paper feed roller and the transfer unit; and when a predetermined time has passed after the detection of the leading edge of recording paper P, the transfer power is turned on or a shutter for use in transfer is opened so that a non-transfer area can be provided to the leading edge portion of the recording paper.

The above-described second object of the present invention can be accomplished by a transfer and conveyance unit having a conveyance belt which is stretched between a pair of rollers, at least one of the rollers is connected to the ground, a recording paper charger opposed to the above-described grounded roller, and a transfer unit opposed to an image carrier through the above-described conveyance belt, and which transfer and conveyance unit is characterized in that: the discharge by the above-described paper charging electrode starts at the leading edge of the transfer paper; the discharge finishes before the trailing edge of the transfer paper comes to the position of the electrode; and after the non-image area of the above-described transfer paper has passed through the position of the transfer charger, the transfer charger starts discharging.

In this case, the non-image area of a transfer paper is defined as the area on the transfer paper onto which a toner image image is not transferred from an image carrier.

In the way described above, the non-image area of a transfer paper is positively attracted to the belt surface by electrostatic force, so that the transfer paper can be positively separated from the image carrier, and at the same time, the amount of ozone generated in the process can be reduced to the minimum. Further, the stain of the wire of the transfer unit is decreased since discharging time is reduced.

The above-described third object of the present invention can be accomplished by an image forming apparatus in which a transfer belt comes into contact with an image carrier wherein the transfer belt can be released from the image carrier, and in which a toner image on the image carrier is transferred onto a recording paper by corona discharge from a transfer unit, and in which the recording paper onto which the image is transferred is conveyed by the transfer belt, and which is characterized in that: when the above-described transfer belt is released from the image carrier, corona discharge is not conducted or the corona discharge is conducted in the condition that the discharge current is controlled below the setting value.

BRIEF DESCRIPTION OF THE DRAWINGS

FIG. 5 is a time chart of image forming conducted in the above-described image forming apparatus.

DESCRIPTION OF THE PREFERRED EMBODIMENTS

Figure 1:
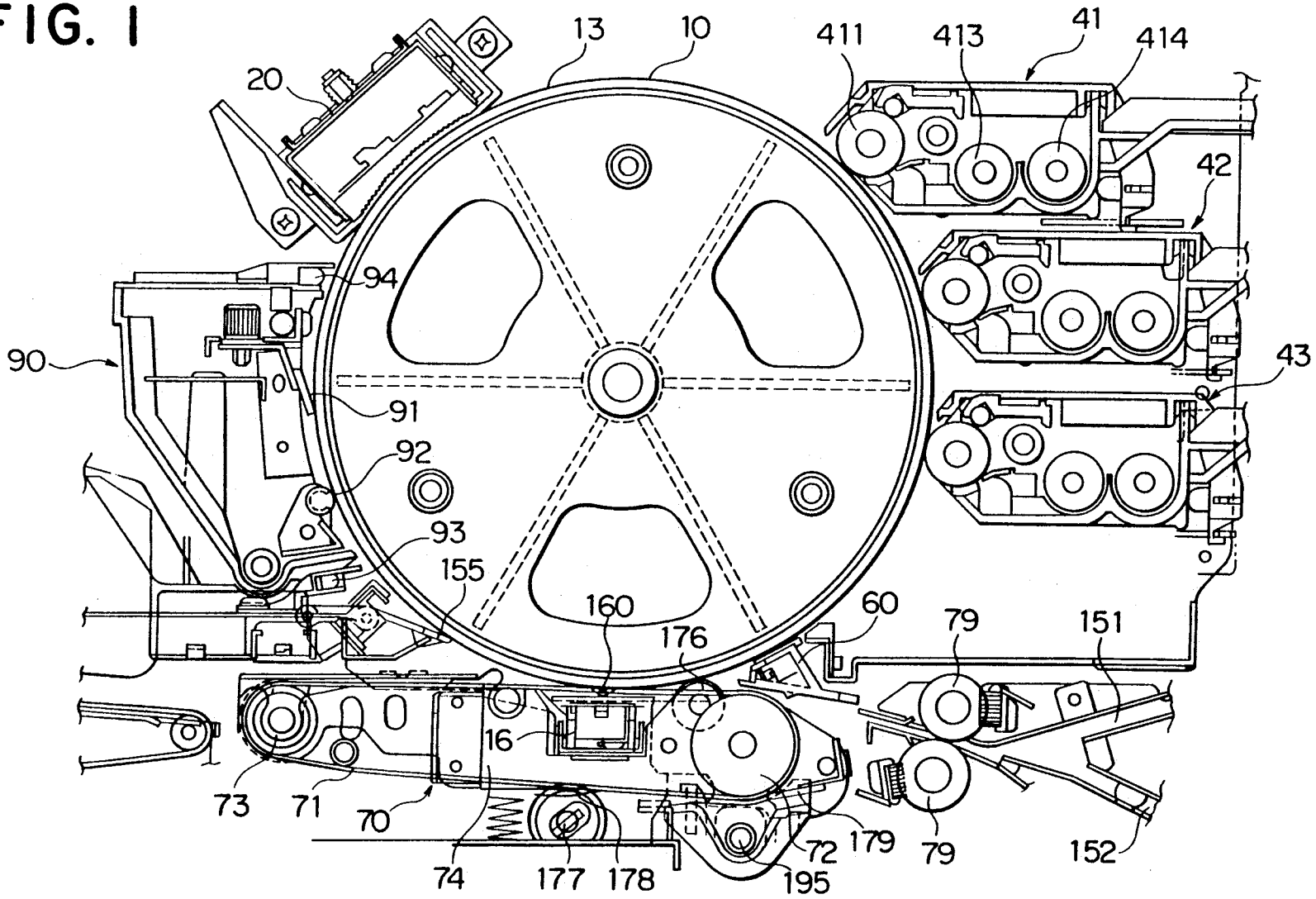
FIG. 1 is a sectional view of an example of the image forming apparatus of the present invention, which shows the composition of the apparatus.

FIG. 1 is a sectional view which shows the composition of an example of the color image forming apparatus of the present invention.

In FIG. 1, the numeral 10 is a photoreceptor drum which a drum-shaped image carrier, on the surface of which OPC photoreceptor is coated, wherein the photoreceptor drum is connected to the ground and rotated clockwise. The numeral 20 is a scorotron charger which impresses electrical charge upon the photoreceptor provided on the circumferential surface of the above-described photoreceptor drum 10. The numeral 13 is an image exposure unit in which exposure light or laser beams are projected on the circumferential surface of the photoreceptor drum 10 so that an image can be focused by an optical exposure system not illustrated in the drawing.

A laser writing system unit is used as the above-described optical exposure system, for instance. When color signals outputted from an image reader located separately from the above-described image forming apparatus, are inputted into the above-described laser writing system unit, laser beams are projected on the circumferential surface of the photoreceptor drum 10 in such a manner that: laser beams generated by a semiconductor laser, the wave length of which is 780 nm, are projected on a polygonal mirror for rotary scanning; the laser beams pass through a fΘ lens; the optical path of the laser beams is bent by a reflection mirror; and the laser beams are projected on the surface of the photoreceptor drum 10 which has been uniformly charged beforehand by the above-described charger 20.

On the other hand, when scanning starts, the laser beams are detected by an index sensor and modulated by the first color signal. The modulated laser beams scan the circumferential surface of the above-described photoreceptor drum 10. In this way, a latent image corresponding to the first color is formed on the image forming portion of the photoreceptor drum 10 by the primary scanning of the laser beams and by the subsidiary scanning conducted by the rotation of the photoreceptor drum 10. The formed latent image is developed by a developing means which contains yellow (Y) toner, for instance, which is the first color, wherein the development is conducted by the method of reversal development. In the way described above, a toner image is formed on the photoreceptor drum surface. The toner image on the image forming portion of the photoreceptor drum 10 passes under a transfer means and cleaning means which are separated from the surface of the photoreceptor drum 10, then the subsequent copy cycle starts.

The following copy cycle is conducted as follows. The above-described photoreceptor drum 10 is charged again by the above-described charger 20. The second color signals outputted from the signal processing unit are inputted into the above-described writing system unit so that the image can be written in to form a latent image on the surface of the photoreceptor drum 10 by the second color signal in the same way as the first color signal. The formed latent image is developed by a developing unit which contains magenta (M) toner, for instance, which is the second color, wherein the development is conducted by the method of reversal development. In the way described above, a magenta toner image is formed. This magenta toner image is registered on the above-described yellow image which has been already formed on the photoreceptor surface.

Thus obtained toner image on the image forming portion of the photoreceptor passes under the transfer means and cleaning means which are separated from the circumferential surface of the photoreceptor drum 10, then the subsequent copy cycle starts.

In the same way explained above, the image is written in on the surface of the photoreceptor drum 10 according to the third color signal so that the latent image can be formed. This latent image is developed by a developing means containing cyan (C) toner, for instance, which is the third color, wherein the development is conducted by the method of reversal development. This cyan toner image is registered on the above-described yellow and magenta toner images so that a color image can be obtained. In some cases, a developing means containing black toner is further provided in order to form a black toner image and register it on the yellow, magenta and cyan toner images so that a color image of high quality can be obtained.

The numerals 41,42,43 are developing units which contain yellow, magenta and cyan toners in order to conduct the above-described development, wherein these developing units have the composition similar to each other.

Figure 2:
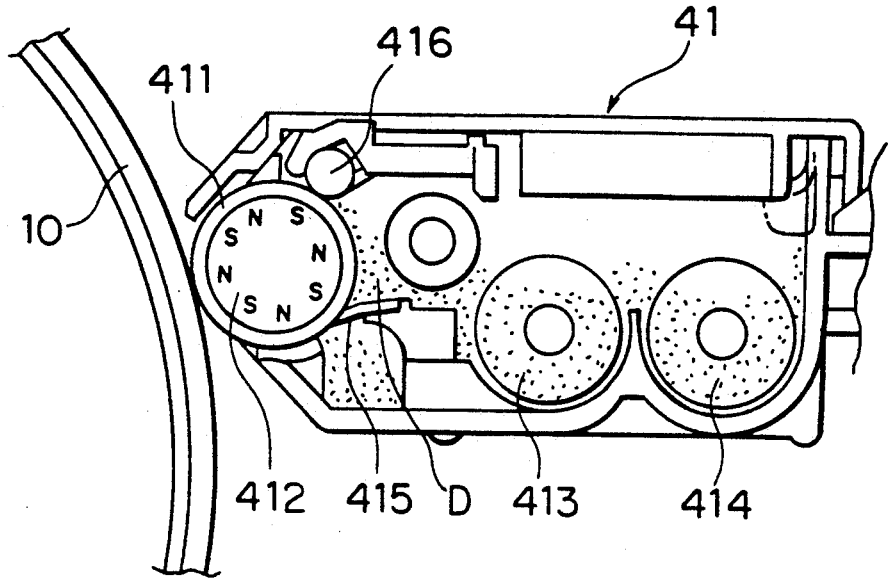
FIG. 2 is a sectional view of a developing unit of the image forming apparatus illustrated in FIG. 1.

FIG. 2 shows the composition of the developing unit 41. The developing sleeve 411, the magnetic roller 412, the stirring screws 413,414 and the scraping board 415 are provided inside the developing unit 41. A roller, which is not illustrated in the drawing, is provided on the same shaft as the developing sleeve 411, which roller always comes into contact with the non-image forming area on the photoreceptor drum surface so that the gap between the developing sleeve 411 and the photoreceptor drum 10 can be maintained to be a constant value of about 0.5 mm.

The toner which is supplied from a toner container not illustrated in the drawing, is sufficiently stirred and mixed with magnetic carrier by the stirring screws 414 and 413 which are rotated in the opposite direction to each other. Two component developing agent D composed of the magnetic carrier and toner is stirred and mixed, then supplied to the developing sleeve 411. The magnetic roller 412 having stationary magnetic poles is provided inside the developing sleeve 411. A thin layer of developing agent D is formed by the developing sleeve 411 and the magnetic roller 412.

The thickness of a thin layer of developing agent D formed on the surface of the developing sleeve 411, is controlled so that it can become thinner than the gap between the developing sleeve 411 and the photoreceptor drum 10. The thickness control is conducted, for example, in such a manner that: the thin developing agent layer forming means 416 composed of a cylindrical rod made from magnetic material, which is installed being opposed to the magnetic poles of the magnetic roller 412, is pressed against the developing sleeve 411 so that developer D can be uniformly formed into a thin layer of about 300 $\mu$ thick. The development bias is impressed upon the developing sleeve 411 so that the latent image on the photoreceptor drum 10 can be developed. After development, residual toner D on the developing sleeve 411 is scraped off by the scraping board 415, then a new thin layer of developing agent D is formed by the above-described method.

The image formation on the photoreceptor drum 10, charging by the charger 10 installed around the photoreceptor drum 10, exposure by the laser writing in system unit of each color, and development by the developing units 41,42,43 are conducted three times according to each color. In this way, toner images are registered on the surface of the photoreceptor drum 10 so that a color toner image can be formed on the image forming area of the photoreceptor drum surface.

The numerals 151,152 are passages of recording papers which are conveyed one sheet by one sheet from a transfer paper supply unit. The numeral 79 are register rollers which convey a recording paper to the transfer location 160 synchronously with the movement of the above-described color toner image on the photoreceptor drum 10.

The numeral 70 is a transfer belt unit. The numeral 71 is a transfer belt. The numerals 72,73 are rollers made from conductive metal. The upstream roller 72 is a roller having a rotatable shaft, and which roller 72 is connected to the ground or kept to be a predetermined potential almost equal to the ground. The downstream roller 73 having a stationary shaft is a roller to drive the transfer belt 71. The numeral 74 is a belt support member, one end of which is connected with the stationary shaft of the roller 73 and the other end of which is connected with the movable shaft of the roller 72, wherein the belt support member 74 is pushed by a spring not illustrated in the drawing so that the roller 72 can be located downward. Consequently, the transfer belt 71 is always withdrawn from the circumferential surface of the photoreceptor drum 10. When image transfer is conducted, the transfer belt 71 comes into contact with the transfer area 160 of the photoreceptor drum 10 in such a manner that: the eccentric cam 177 which is controlled by a control unit, pushes the belt support member 74 upward through the leaf spring 178 so that the belt support member 74 can be rotated around the roller 73; and the rollers 74 which are provided to both sides of the belt support member 74, come into contact with the side portions of the photoreceptor drum 10, which are not an image forming areas, so that the transfer belt 71 comes into contact with the transfer section 160 on the photoreceptor drum 10.

The numeral 179 is a cleaning blade which scrapes off the adhering toner on the transfer belt 71. The numeral 195 is a toner conveyance pipe, inside of which a flexible conveyance screw is provided, and conveys the toner scraped off by the cleaning blade 179 to a toner collecting box not illustrated in the drawing.

The numeral 16 is a charger for use in transfer which is installed to the position opposite to the transfer unit 160. The numeral 60 is a charger for use in charging a recording paper, which charger 60 is located in a wedge-shaped space between the transfer belt 71 and the photoreceptor drum 10 so that its opening can be opposed to the transfer belt 71 at the position opposed to the roller 72.

The developing unit 43 containing the toner of the third color, starts development. After that, the following working actions are almost simultaneously conducted: the operation of the register roller 79; the pressure contact of the transfer belt unit 70 with the photoreceptor drum; and the impression of high voltage upon the discharge wire of the charger 60 for use in charging a recording paper.

In the way described above, the charger 60 for charging a recording paper 60 conducts a corona-discharge against a recording paper supplied by the transfer sheet supply unit so that the recording paper can be charged to the same polarity as the toner on the photoreceptor drum 10. The roller 72 which is in the state almost equal to the ground, is used as an opposed electrode to the above-described charger 60 for charging a recording paper, so that charging can be conducted effectively and positively. The charger 60 is located very close to the transfer unit 160, so that the electrical charge is not decreased while the recording paper is conveyed. Accordingly, the recording paper can be tightly attracted to the transfer belt 71 and conveyed to the transfer location 160.

When the leading edge of the recording paper reaches the transfer unit 160, the recording paper is pressed against the photoreceptor drum 10 by the transfer belt 71. Then, the charger 16 charges the recording paper on the transfer belt 71 to the inverse polarity to the toner on the photoreceptor drum 10 so that the above-described toner image can be transferred onto the recording paper. (The impression of the transfer potential by the charger 16 will be described in detail later.) The recording paper onto which the toner image has been transferred, is further conveyed by the transfer belt 21 to the fixing unit not illustrated in the drawing. Then the image on the recording paper is fixed and the recording paper is delivered onto a delivery tray located outside the apparatus. The numeral 155 is a separation claw which is used for preventing a recording paper from going upward.

Figure 3:
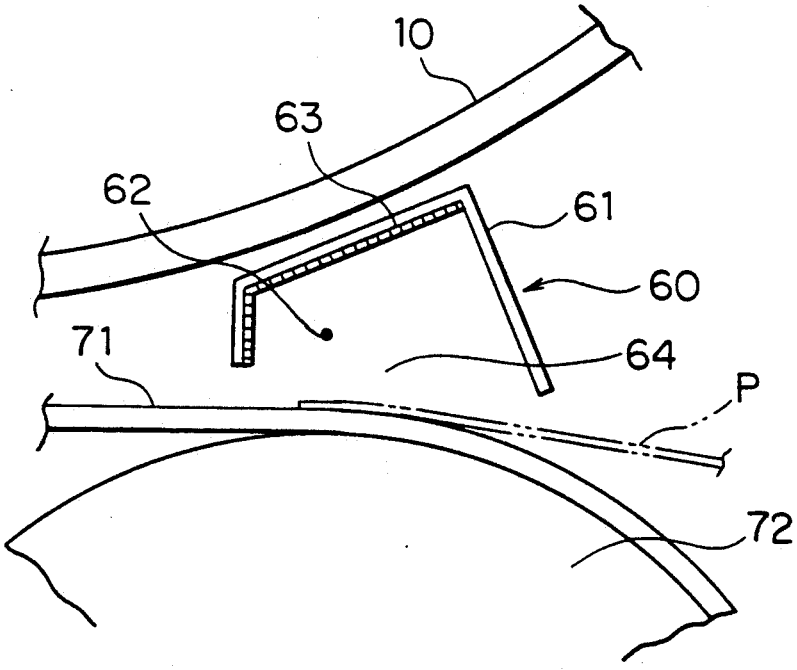
FIG. 3 is a sectional view which shows the portion proximal to the paper charger of the image forming apparatus illustrated in FIG. 1.

FIG. 3 is a sectional view which shows the portion of the apparatus in the proximity of the charger 60 for charging a recording paper illustrated in FIG. 1. In FIG. 3, the numeral 61 is a back plate made of a stainless steel sheet, a surface treated sheet or an aluminum sheet, which is provided for shield action and formation of a stable electric field, and the opening of the charger 60 is opposed to the transfer belt 71. The numeral 62 is a discharge wire composed of a tungsten wire of 60 to 100 μm diameter The function of the back plate 61 can be described as follows: when the charger 60 is charging a recording paper, a stable electric field can be formed, so that a corona-discharge can be stably conducted; and unnecessary portions can be prevented from being charged. The potential of 5 to 6 KV is impressed upon the discharge wire 62 during discharging operation. At this time, there is a danger that sparks are caused unless the distance between the discharge wire 62 and the naked back plate 61 is not less than 6 to 7 mm. In the present invention, a tape made from polyester resin, for example, is adhered to the photoreceptor side of the internal wall of the back plate 61 so that the insulating layer 63 can be formed. Consequently, even though the discharge wire 62 is located close to the back plate 61, sparks can not be caused.

As illustrated in FIG. 3, the back plate 61 is formed C-shaped, for example, so that the shape can be fitted to a wedge-shaped space. Accordingly, the size of the back plate is small, so that the charger 60 can be installed very close to the transfer unit 160.

The charger 60 for use in charging a recording paper can be described as follows: the charger 60 is provided to the position opposed to the roller 72; the charger 60 conducts a corona-discharge against recording paper P which is conveyed by the register rollers 53; the charger 60 charges recording paper P effectively and positively, wherein the roller 72 which is almost in the state of the ground is used as the opposite electrode; and the distance from the charger 60 to the transfer location 160 can be remarkably shortened, so that recording paper P is tightly attracted to and conveyed by the transfer belt 71, and after transfer, recording paper P can be positively separated from the photoreceptor drum 10.

Furthermore, high electric potential of the same polarity as the toner in the developing agent, is impressed upon the discharge wire 62 of the charger 60 so that recording paper P can be charged to the same polarity as the toner. Accordingly, the toner placed on the surface of the photoreceptor drum 10 is not attracted to recording paper P until recording paper P arrives at the transfer location 160. As a result, there is caused no problem of blur and bleeding of an image and a sharp and clear copy image can be obtained.

The details of the above-described impression of high potential are as follows: when the circumferential speed of the photoreceptor drum 10 is 140 mm/sec, the width of the photoreceptor is 300 to 350 mm, and the thickness of the recording paper is 65 $g/m^2$, the discharging current is controlled to be 20 to 50 μA. At this moment, the component of electric current which flows to recording paper P is 10 to 20 μA in case of high humidity, and is 5 to 10 μA in the case of low humidity.

When recording paper P has been conveyed to the transfer unit 16 and its leading edge portion has passed through the transfer location 160, high potential of the inverse polarity to the toner on the photoreceptor drum is impressed upon the transfer unit 160 under the constant current control so that the toner image can be transferred, which will be described later. This constant current control is conducted as follows, for example: in the case of high humidity, the constant current is 350 μA; and in the case of low humidity, the constant current is 200 μA.

In the way explained above, the charging current is adjusted according to the humidity by which image transfer is most affected, so that the electric attraction and the transfer efficiency can be maintained to the most desirable level.

The composition of the transfer belt 71 which is used as a transfer means, is as follows: for example, the transfer belt 71 is composed of two layers; the main body of the transfer belt is made of an endless belt of 0.5 to 1 mm thick, a high resistance sheet is used, the resistance of which is $10^{10}$ Ω cm, and the material of the sheet is silicon rubber, polyurethane rubber or butyl rubber; and the upper layer of the sheet is coated with fluorine contained resin by the method of spray-coating, so that the frictional resistance can be reduced.

After image transfer has been completed, the surface of the photoreceptor drum 10 is cleaned by the cleaning unit 90. The cleaning unit 90 is provided with the cleaning blade 91 and the toner collecting roller 92 which electrostatically collects the residual toner. While toner images are formed on the circumferential surface of the photoreceptor drum 10, the above-described cleaning blade 91 is withdrawn, and when image transfer has been completed, the cleaning blade 91 comes into contact with the photoreceptor drum 10 so that cleaning can be conducted. The discharge lamp 93 is provided to the upstream position of the cleaning unit 90 and the discharge lamp 94 is provided to the downstream position. The discharge lamp 93 eliminates the electrical charge so that the residual toner on the circumferential surface of the photoreceptor drum 10 can be easily removed. The discharge lamp 94 uniformly eliminates the electrical charge on the cleaned surface of the photoreceptor drum 10 so that the photoreceptor drum can be uniformly charged for the subsequent image forming. The toner conveyance pipe 195 having a toner conveyance screw made from flexible material is provided to the bottom portion of the cleaning unit 90 so that the waste toner collected by cleaning can be conveyed to a toner recovery box not illustrated in the drawing. After the cleaning of the photoreceptor drum 10 has been completed, the process proceeds to the subsequent process.

Figure 4:
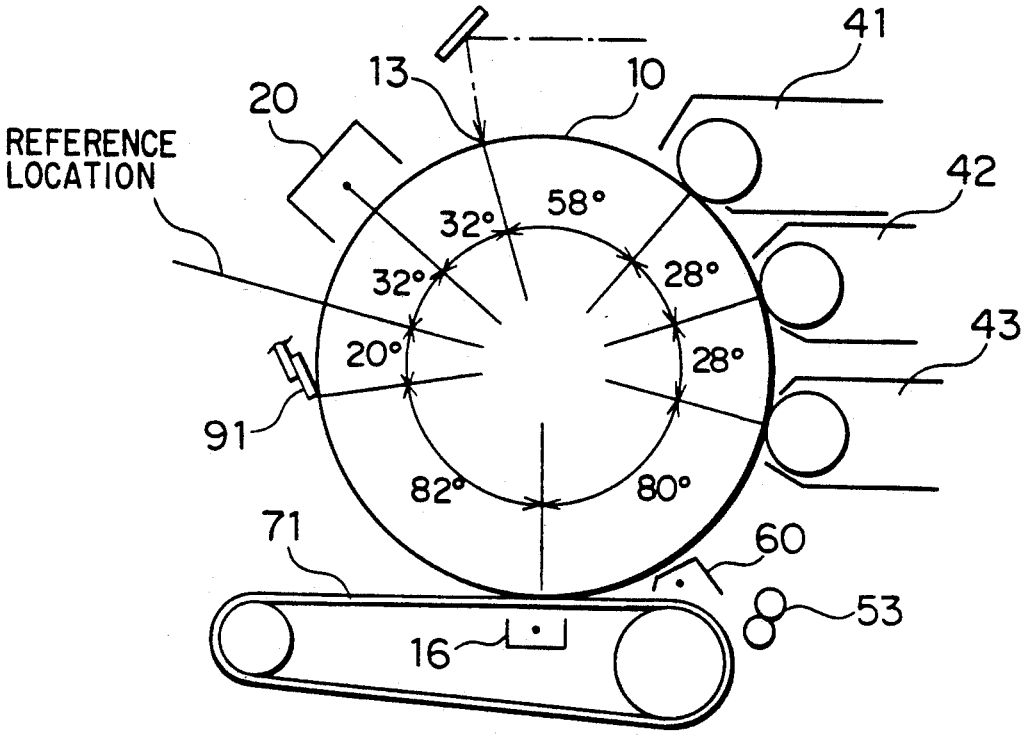
FIG. 4 is a schematic illustration which shows the layout of each unit of the above-described image forming apparatus.

The image forming means of the above-described image forming apparatus shown in FIG. 1, are provided around the photoreceptor drum 10, wherein the positional relation is illustrated in FIG. 4. As shown by the time chart in FIG. 5, the sequence control can be conducted by the control unit provided in the apparatus so that a color image can be formed.

Next, the relation between the transfer potential impressing timing and the position of recording paper P will be explained as follows.

Figure 6:
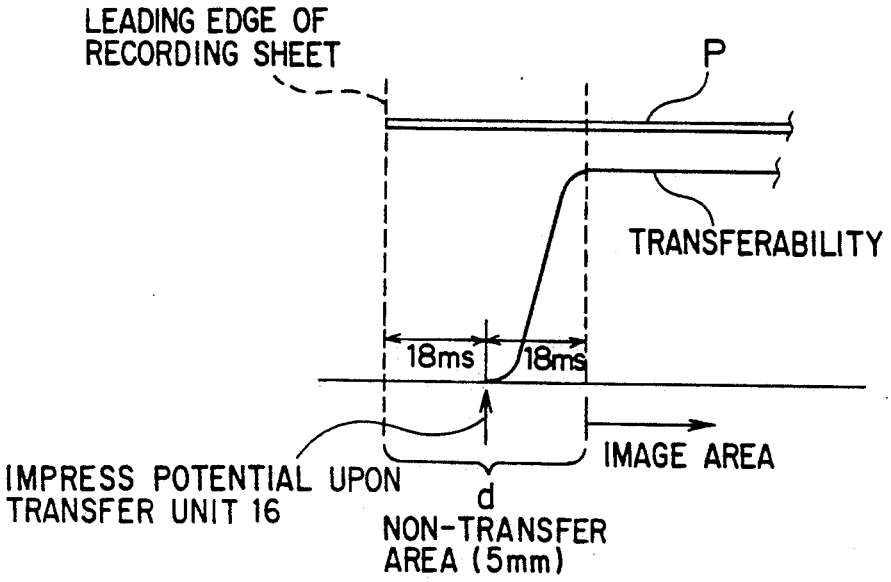
FIG. 6 is a graph which shows the variation of transferability after transfer potential has been impressed upon the transfer unit.
Figure 7:
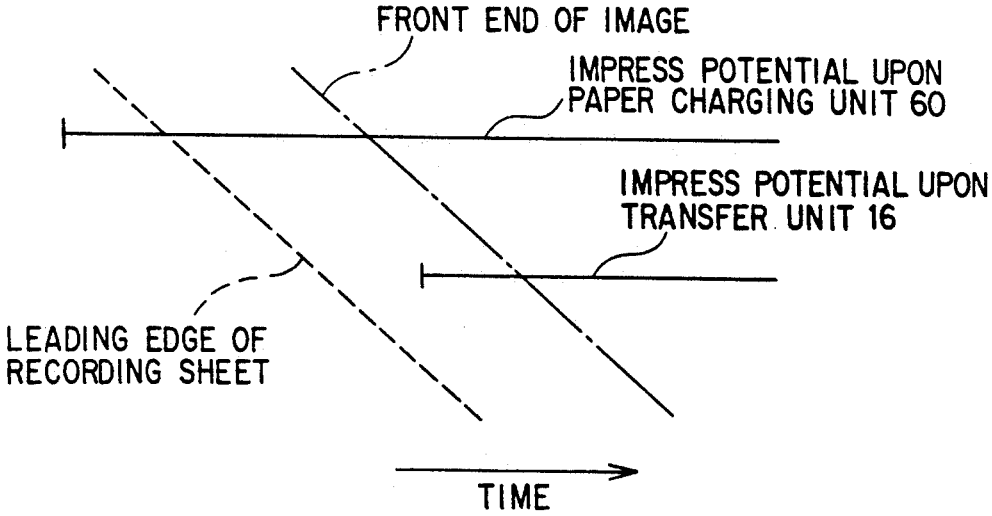
FIG. 7 is a partially enlarged time chart of FIG. 5.

FIG. 6 shows the variation of transferability of the transfer unit 16 after transfer potential has been impressed, and it also shows the relation between the transferability and the position of recording paper P. FIG. 7 is an enlarged time chart of FIG. 5 which shows the portion in which transfer potential is impressed upon the transfer unit. As shown in the above graph and drawing, process control is conducted in the image forming apparatus of the present invention in such a manner that: after the leading edge of recording paper P has passed through the transfer section 160, transfer potential is impressed upon the transfer unit 16, and after that, scanning to read out an image, or writing-in of printer starts.

In the way described above, non-transfer area "d", the width of which is several millimeters, for instance 5 mm, is formed at the leading edge of recording paper P, and transfer potential is impressed so that the transferability rises up while the non-transfer area "d" passes through the transfer section 160. For example, when the circumferential speed of the photoreceptor drum 10 was 140 mm/sec, transfer potential was impressed 18 ms after the leading edge of recording paper P had passed through the transfer section 160, then the transferability rose up completely, so that an image was positively recorded on recording paper P as far as the image was reciprocal to recording paper P having the margin of 5 mm.

Since the image forming apparatus of the present invention is provided with the composition and process control explained above, images can be positively recorded by the apparatus without causing the problem that the front edge of a toner image is broken. Further, the separability of a recording paper is excellent.

Figure 10:
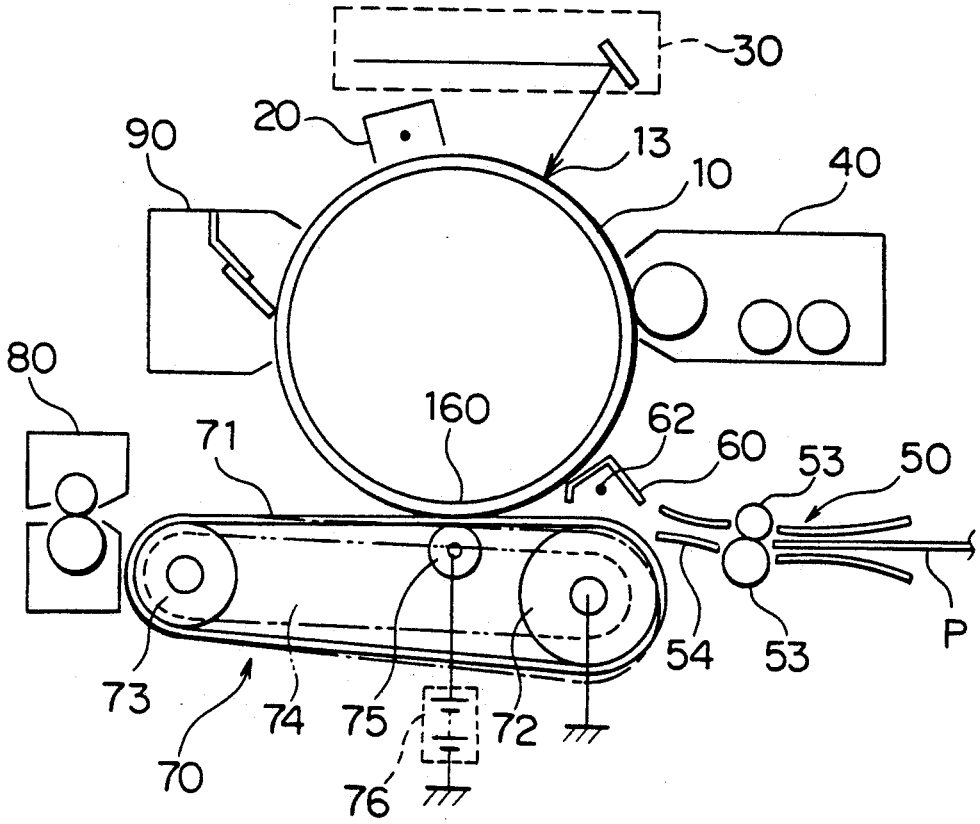
FIG. 10 is a sectional view which shows an example of the image forming apparatus of the present invention.

FIG. 10 is a cross-sectional view of an example of the image forming apparatus of the present invention.

Figure 8:
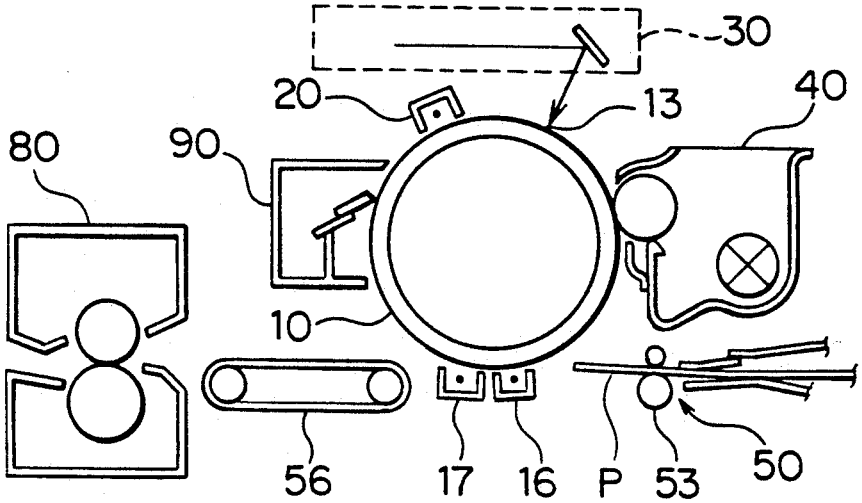
FIG. 8 is a sectional view which shows an example of the conventional electrostatic copier.
Figure 9:
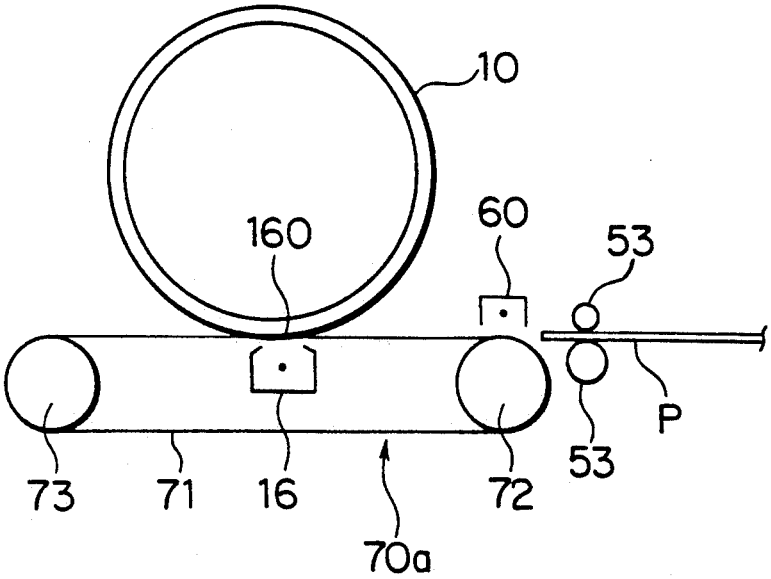
FIG. 9 is a schematic illustration which shows the outline of a conventional transfer belt unit.

In FIG. 10, like parts are shown by corresponding reference characters throughout FIG. 8 and FIG. 9, and the motions are approximately the same, so that the overlapping explanations will be omitted.

The numeral 54 is a guide plate installed between the paper feed roller 53 and the roller 72. The numeral 70 is a transfer belt unit. The numeral 75 is a transfer bias roller made from conductive metal. The numeral 76 is a power source which supplies high potential to the transfer bias roller 75, which high potential is of reverse polarity to the adhering toner of the transfer bias. The rollers 72,73 are made from conductive material, and the upstream roller 72 is grounded or maintained to be almost the same potential as the ground. The numeral 74 illustrated by a chained line is a roller support member, one end of which is connected with the stationary shaft of the roller 73, and the other end of which is connected with the movable shaft of the roller 72. The roller support member 74 supports the transfer bias roller 75 via insulating material so that the transfer bias roller 75 can come into contact with the transfer belt 71, wherein the roller support member 74 is always pushed downward by a spring member not illustrated in the drawing so that the roller 72 can be located downward. Accordingly, while an image is not transferred onto a recording paper, the transfer belt 71 is separated from the circumferential surface of the photoreceptor drum 10 as shown by a chained line in the drawing. When transfer is conducted, the roller support member 74 is rotated counterclockwise by a motor or solenoid, for instance, which is activated by the control of the control unit, so that the transfer belt 71 can come into contact with the photoreceptor drum 10. If the paper feed roller 53 is located close to the roller 72, the above-described guide plate 54 can be abolished.

The composition of the transfer belt 71 which is used as a transfer means, is as follows: for example, the transfer belt 71 is composed of two layers; the main body of the transfer belt is made of an endless belt of 0.5 to 1 mm thick, a high resistance sheet is used, the resistance of which is $10^{10}\Omega$ cm, and the material of the sheet is silicon rubber, polyurethane rubber or butyl rubber; and the upper layer of the sheet is coated with fluorine contained resin by the method of spray-coating, so that the frictional resistance can be reduced.

Figure 11:
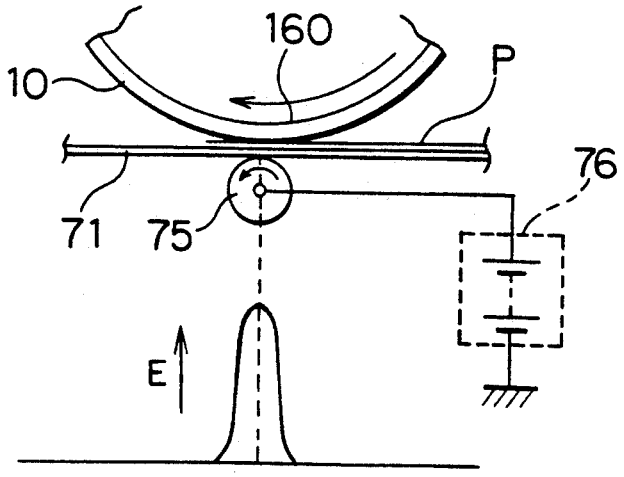
FIG. 11 is a sectional view of a portion of the image forming apparatus shown in FIG. 10, wherein the portion is proximal to the transfer bias roller, further a graph showing the electric field strength of transfer is attached to FIG. 11.

FIG. 11 is a drawing which shows the distribution of the electric field strength E for transfer when the transfer bias roller 75 comes into contact with the transfer belt 71 and bias potential is impressed upon the transfer belt 71. As illustrated in the drawing, the distribution of the electric field strength for transfer becomes sharp compared with the conventional transfer unit 16 in which corona discharge is conducted, so that charging can be limited to a very narrow range. In the method described above, corona discharge is not adopted, so that ozone is not generated. As a result, the life time of the transfer belt 71 can be extended, and further bad influence caused by ozone can be eliminated.

It is preferable that the diameter of the bias roller 75 is reduced as far as the mechanical strength of the roller can be maintained in order to reduce the range of distribution of the electric field strength for transfer.

Then, the working action of the above-described transfer belt unit 70 will be explained as follows. The transfer belt 71 comes into contact with the photoreceptor drum 10 and high potential is impressed upon the discharging electrode 62 of the pre-transfer charger 60 simultaneously with the start of rotation of the paper feed roller 53, wherein the transfer belt 71 has already been set in motion simultaneously with the start of copy operation. The leading edge of recording paper P is conveyed by the paper feed roller 53 to the effective discharging area between the discharging electrode 62 of the pre-transfer charger 60 and the transfer belt 71. In this area, recording paper P is electrostatically attracted by the transfer belt 71 and conveyed to the transfer section 160. When a constant length (for example, 5 to 7 mm) of the leading edge of recording paper P has passed the transfer section 160, the power source 76 for transfer of the transfer bias roller 75 is turned on so that image transfer can be started. In the way described above, a constant length of non-transfer area can be formed at the leading edge of recording paper P, and the transfer area can be formed very close to the non-transfer area.

The changeover between the transfer charging and the non-charging may be conducted in such a manner that: the transfer bias roller 75 comes into contact with the transfer belt 71 and is released from the transfer belt 71. Specifically, while image transfer is not conducted, the transfer bias roller 75 is separated from the transfer belt 71 even when the transfer bias is impressed upon the transfer bias roller 75. When a constant length of the leading edge of recording paper P has passed through the transfer section 160, the transfer bias roller 75 comes into contact with the transfer belt 71 so that transfer charging can be conducted. In this way, the non-transfer area can be formed at the leading edge of recording paper P, and the transfer area can be formed close to the non-transfer area.

The above-described transfer charging is not conducted by corona discharge but conducted by direct contact of roller 75 in high potential, so that the voltage of the power source may be low. Accordingly, the above-described transfer charging has such an advantage that the cost of the transfer power source 76 can be reduced.

Figure 12:
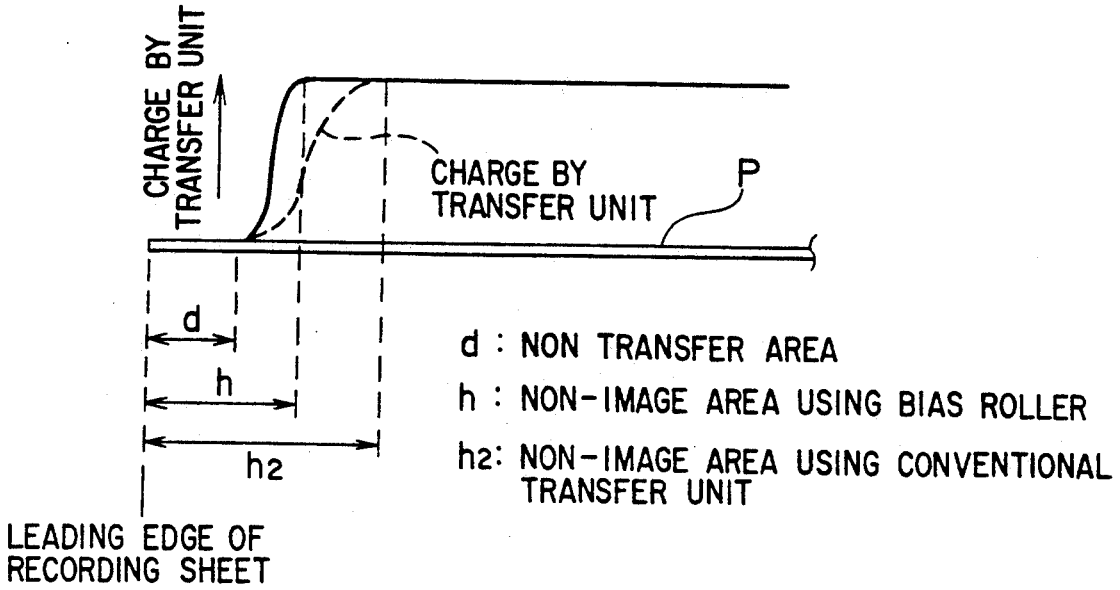
Figure 19:
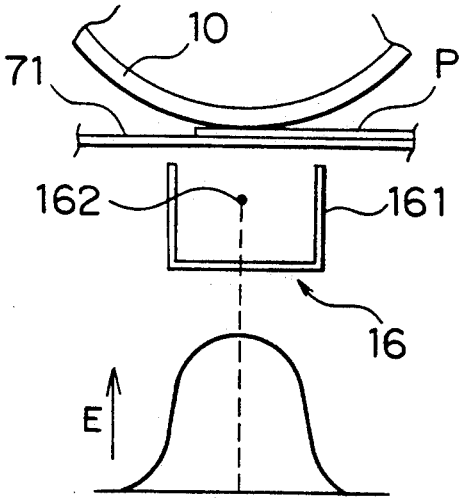

FIG. 12 shows non-transfer area "d" formed at the leading edge of recording paper P according to the present invention, wherein the comparison is made between the transfer unit of the present invention and the the conventional transfer unit 16 illustrated in FIG. 19. According to the present invention, non-transfer area "d", the boundary of which is clear, can be formed at the leading edge of recording paper P, and the transferability rises up sharply at the boundary between the non-transfer area and the transfer area, so that the length of non-transfer area "h" at the leading edge of recording paper P can be reduced.

The above-described non-transfer area "d" has been kept charged since it was charged by the pre-transfer charger 60, so that non-transfer area "d" at the leading edge of recording paper P is tightly attracted to the surface of the transfer belt 71. Therefore, the separability of recording paper P with regard to the photoreceptor drum 10 can be improved.

The above-described pre-transfer charger 60 of the present invention is installed opposed to the roller 72 which is grounded or kept in the state of low potential almost equal to the ground, and the pre-transfer charger 60 conducts corona discharge against recording paper P conveyed by the transfer sheet supply unit 50, wherein the roller 72 is used as the opposed electrode, so that charging can be effectively conducted. Further, the distance between the above-described pre-transfer charger 60 and the transfer section 160 can be extremely reduced, so that the leak of electrical charge during the conveyance of recording paper P can be decreased. Therefore, the transfer belt 71 can tightly attract recording paper P to convey it.

High electric potential of the same polarity as the charged toner in the developing agent, is impressed upon the discharging electrode 62 of the pre-transfer charger 60. Consequently, the toner placed on the surface of the photoreceptor drum 10 is not attracted until recording paper P arrives at the transfer section 160, so that the quality of copy image can be improved.

High electric potential is impressed upon the discharging electrode 62 of the pre-transfer charger 60 in such a manner that: when the circumferential speed of the photoreceptor drum 10 is 140 mm/sec, the image width is 300 to 350 mm, and the paper thickness is 65 $g/m^2$, the charging current is controlled to 20 to 50 $\mu A$. At this moment, the component of electric current flowing to recording paper P is 10 to 20 $\mu A$ in the case of high humidity and 5 to 10 $\mu A$ in the case of low humidity.

High electric potential of the reverse polarity to the charged toner is impressed upon the transfer bias roller 75 under the constant-voltage control in order to transfer a toner image onto recording paper P. When the constant-voltage control is conducted in the process of image transfer, the voltage between the roller and the drum becomes constant without being influenced by environmental conditions, so that image transfer can be stably conducted.

According to the example described above, the image forming apparatus can be provided which is characterized in that: a constant length of non-transfer area having clear boundary is positively formed at the leading edge of the transfer sheet, so that the unnecessary non-image area can be eliminated; a transfer belt, which has improved separability of recording paper from an image carrier, can be provided; the papering property is very excellent; the generation of ozone which is harmful to human body and the transfer belt, can be reduced; and the image forming portion on a recording paper can be extended.

Figure 13:
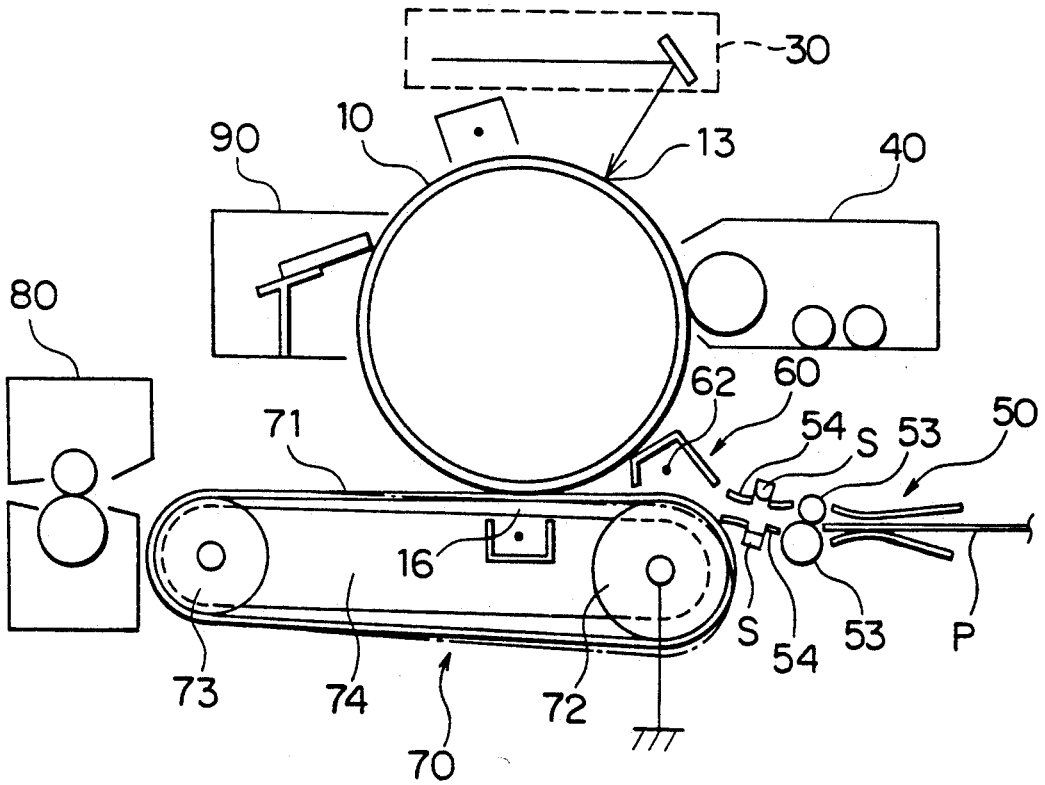
FIG. 13 is a schematic illustration which shows the composition of the transfer belt of the present invention.

FIG. 13 is a cross-sectional view of an example the image forming apparatus of the present invention.

The numeral 54 is a guide plate which is installed between the paper feed roller 53 and the roller 72. S in the drawing is a paper detection sensor to detect the leading edge of recording paper P, which paper detection sensor is composed of a light emitting element and light receiving element. The rollers 72,73 are made from conductive material, and the upstream roller 72 is grounded of kept to be a predetermined potential which is almost the same as the ground.

The numeral 74 is a roller support member, one end of which is connected with the stationary shaft of the roller 73, and the other end of which is connected with the movable shaft of the roller 72. The roller support member 74 supports the transfer bias roller 75 via insulating material so that the transfer bias roller 75 can come into contact with the transfer belt 71, wherein the roller support member 74 is always pushed downward by a spring member not illustrated in the drawing so that the roller 72 can be located downward. Accordingly, while an image is not transferred onto a recording paper, the transfer belt 71 is separated from the circumferential surface of the photoreceptor drum 10 as shown by a chained line in the drawing. When transfer is conducted, the roller support member 74 is rotated counterclockwise by a motor or solenoid, for instance, which is activated by the control of the control unit, so that the transfer belt 71 can come into contact with the photoreceptor drum 10. If the paper feed roller 53 is located close to the roller 72, the above-described guide plate 54 can be abolished.

The composition of the transfer belt 71 which is used as a transfer means, is as follows: for example, the transfer belt 71 is composed of two layers; the main body of the transfer belt is made of an endless belt of 0.5 to 1 mm thick, a high resistance sheet is used, the resistance of which is $10^{10}\Omega$ cm, and the material of the sheet is silicon rubber, polyurethane rubber or butyl rubber; and the upper layer of the sheet is coated with fluorine contained resin by the method of spray-coating, so that the frictional resistance can be reduced.

Next, the working action of the transfer belt unit 70 will be explained as follows. When the paper feed roller 53 is set in motion, the transfer belt 71 is simultaneously driven and pressed against the photoreceptor drum 10, and at the same moment high potential for charging is impressed upon the pre-transfer charger 60. Then, the leading edge of recording paper P is conveyed to the effective discharging area between the discharging electrode 62 of the pre-transfer charger 60 and the transfer belt 71. At this moment, paper sensor P detects the passage of the leading edge of recording paper P. The power source for the transfer unit 16 is turned on when a predetermined period of time has passed since the leading edge of recording paper P was detected. (In this case, the predetermined period of time is defined as the time which has passed from the moment when the leading edge of recording paper P passed through paper sensor S to the moment when the non-transfer area at the leading edge of recording paper P, for example the length of which is 5 mm, has passed through the transfer section 160.)

Figure 14:
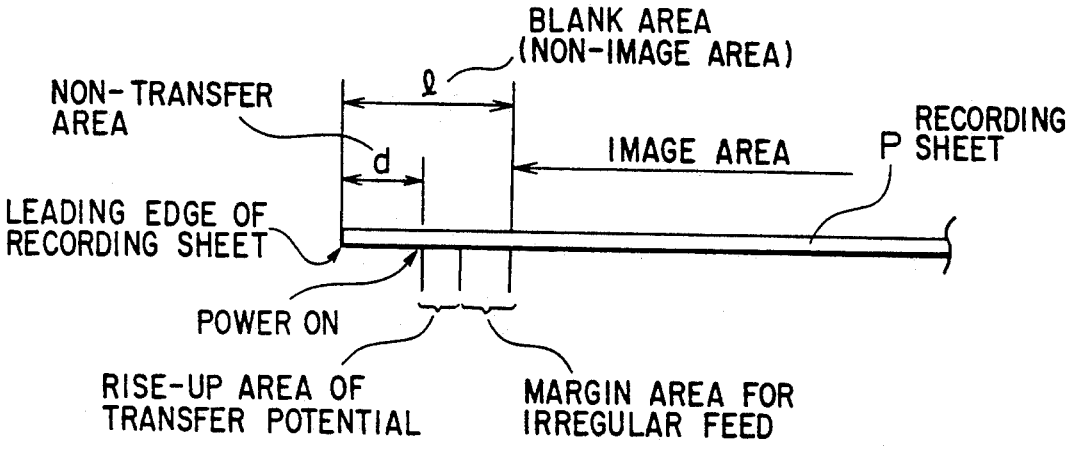
FIG. 14 is a schematic illustration which shows a non-transfer area and a non-image area on a recording paper.

In the case of a transfer unit provided with a shutter at the opening portion, the above-described power source is turned on before a predicted shutter opening time, and after a predetermined period of time has passed from the above-described detection time, the above-described shutter is opened. In this way, as illustrated in FIG. 14, a predetermined length (for example, about 5 mm) of non-transfer area "d" is always formed at the leading edge of recording paper P, and recording paper P can be positively attracted to the surface of the transfer belt 71. Further, the length of the non-image area 1 at the leading edge of recording paper P can be reduced to the minimum.

In order to form a narrow range of non-transfer area "d", it is preferable that the distribution of charging current by the charging unit 16 has the shape which is sharply cut out.

Figure 18:
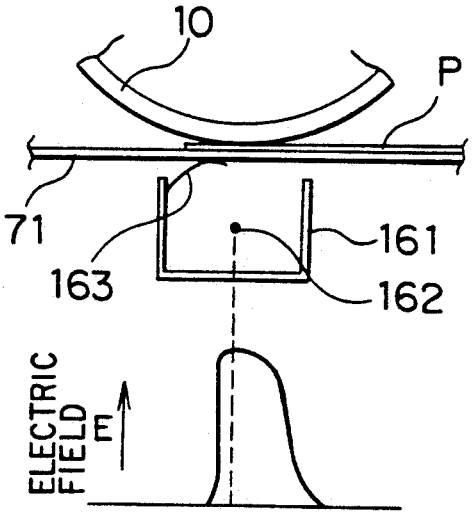
FIG. 18 to FIG. 20 are sectional views which show the transfer unit illustrated in FIG. 16 and the conventional transfer unit, wherein the graphs showing charged current distribution are attached to the drawings.
Figure 20:
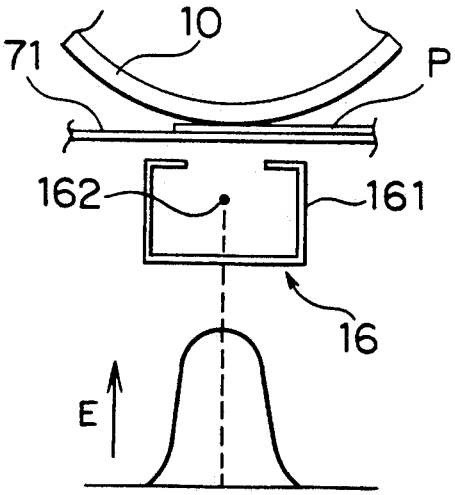

FIG. 18 to FIG. 20 show the sectional views of various transfer units and the relations between the sectional views and the electric field distribution. In the drawings, the numeral 161 is a shield plate. The numeral 162 is a discharging electrode. The numeral 163 is a squeeze plate which is provided on the down stream side internal wall of the shield plate 163 so that half the down stream side opening of the transfer unit can be closed by the squeeze plate, wherein the squeeze plate 161 is made from insulating material and formed so that the cross section can be circular. As illustrated in FIG. 18, the shape of the distribution curve of electric field becomes sharp since the squeeze plate 163 is installed in the transfer unit. In the example to which the transfer unit 16 illustrated in FIG. 18 is applied, the boundary of the non-transfer area "d" becomes further clear, so that the non-image area 1 can be further reduced.

In this example, the apparatus is composed in the way explained above, so that the image forming apparatus can be provided which is characterized in that: a constant length of non-transfer area can be formed at the leading edge of a recording paper; the non-image area can be reduced to the minimum because it is not necessary to allow a margin in case there is caused a problem of malfunction; the transfer belt has high attraction and conveyance force when it conveys a recording paper; and the separability of a recording paper from an image carrier is high so that papering property is excellent.

Figure 15:
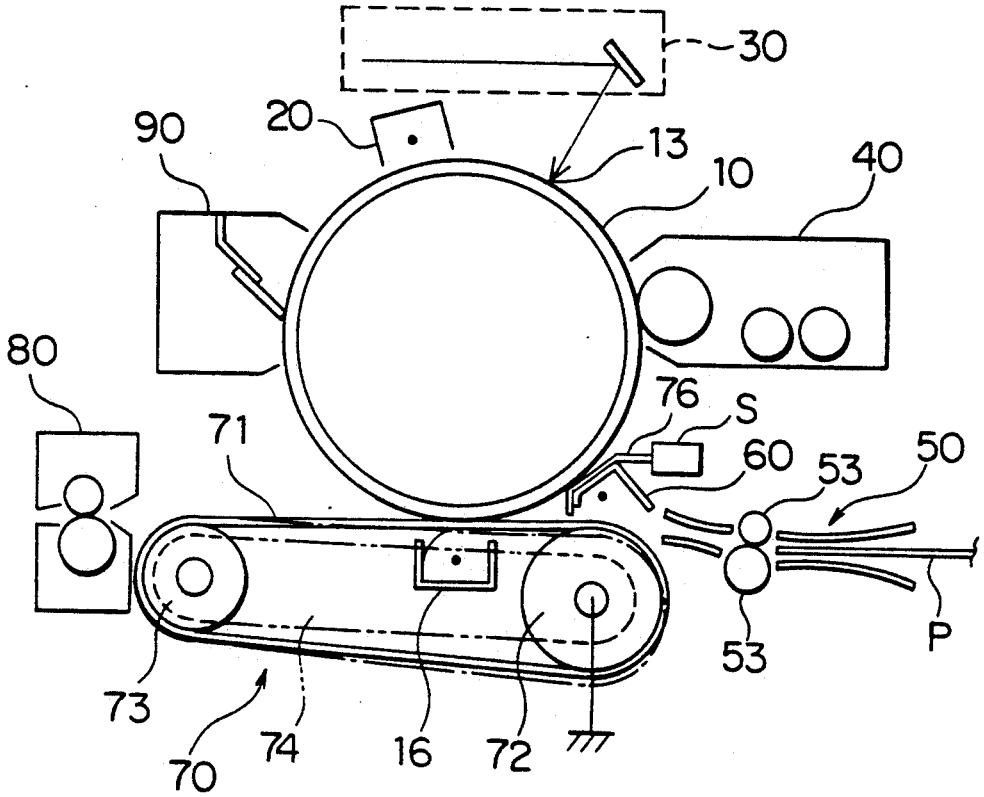
FIG. 15 is a sectional view which shows an example of the image forming apparatus of the present invention.

FIG. 15 is a cross-sectional view of an example of the image forming apparatus of the present invention, the object of the example is the same as that illustrated in FIG. 13.

Figure 16:
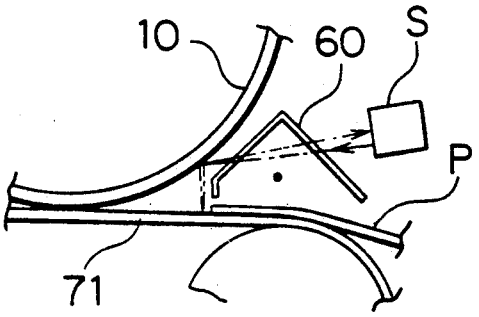
FIG. 16 and FIG. 17 are schematic illustration which show the arrangement of a sensor in the example.
Figure 17:
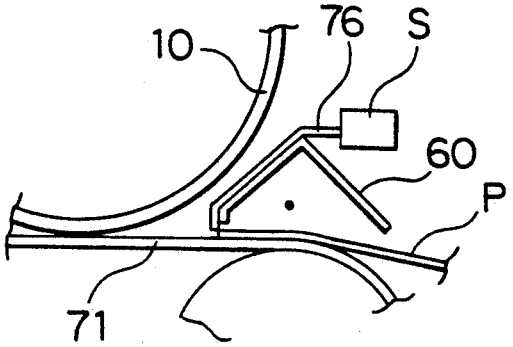

FIG. 16 and FIG. 17 show examples of sensor S illustrated in FIG. 15. In the example illustrated in FIG. 16, the smooth circumferential surface of the photoreceptor drum 10 is used as a reflection surface. The existence of recording paper P on the transfer belt 71 can be detected as follows. The edge portion of the photoreceptor drum surface opposed to recording paper P, which edge portion is out of the image forming surface, is used as a mirror surface to reflect the light emitted by the light emitting element of sensor S. The reflected light is projected on the transfer belt 71, and the light reflected by the surface of the transfer belt 71 is received by the light receiving element of sensor S via the mirror surface of the photoreceptor drum 10. The existence of recording paper P can be detected by the difference of reflectance between the transfer belt 71 and recording paper P.

FIG. 17 shows an example in which glass or plastics is used as a light guide means of the optical fiber 76. The existence of recording paper P on the transfer belt 71 is detected by the difference of reflectance between the transfer belt 71 and recording paper P in the same way as the example shown in Fig. 16. In both cases the main body of sensor S is not located between the pre-transfer charger 60 and the photoreceptor drum 10, so that any interference is avoided and the pre-transfer charger 60 can be located close to the photoreceptor drum 10. The leading edge of recording paper P can be detected after the leading edge has been attracted by the transfer belt 71, the accuracy of detection is very high.

Next, the working action of the transfer belt 70 will be explained as follows. The transfer belt 71 comes into contact with the photoreceptor drum 10 and high potential is impressed upon the discharging electrode 62 of the pre-transfer charger 60 simultaneously with the start of rotation of the paper feed roller 53, wherein the transfer belt 71 has already been set in motion simultaneously with the start of copy operation. Then, the leading edge of recording paper P is conveyed by the paper feed roller 53 to the effective discharging area formed between the discharging electrode 62 of the pre-transfer charger 60 and the transfer belt 71, and recording paper P is attracted by the transfer belt 71 and conveyed to the transfer section 160. When the leading edge of recording paper P has passed through the pre-transfer charger 60, sensor S sends the signal of passage of recording paper P to the control unit of the apparatus body. When a predetermined time which is necessary for the leading edge of recording paper P to pass through the transfer section 160, for example the time necessary for the non-transfer area of which length is 5 mm to pass through the transfer section 160, has passed after the signal was received, the control unit sends a signal to turn on the power source of the transfer unit 16 in order to start transfer of toner image. In the way described above, a constant length of non-transfer area can be positively formed on the leading edge of recording paper P. Further, the non-transfer area, the boundary of which is sharp, having no redundant space, can be formed by the action of the above-described squeeze plate 163 of the transfer unit 16.

In the case of the transfer unit 16 having a shutter at its opening portion, the above-described control unit controls the apparatus in such a manner that: the power source of the transfer unit 16 is turned on simultaneously with the power source of the pre-transfer charger 60; and the shutter is opened when a predetermined time has passed after the above-described detection signal was received. In the way explained above, non-transfer area "d", the length of which is constant (for example, about 5 mm), and the boundary of which is very sharp, can be formed on the leading edge portion of recording paper P. In this way the leading edge of recording paper P is tightly attracted to the transfer belt 71 and the length of the non-image area "h" of the leading edge of recording paper P can be minimized.

The above-described pre-transfer charger 60 is opposed to the roller 72 which is grounded or kept to be a potential almost the same as the ground. The pre-transfer charger 60 conducts corona discharge against recording paper P conveyed from the transfer sheet supply unit 50 and charges recording paper P using the roller 72 as the opposed electrode. The distance from the pre-transfer charger 60 to the transfer section 160 is made so short that the leak of electrical charge can be reduced during conveyance, and recording paper P is tightly attracted to the transfer belt 71 to be conveyed.

High potential, the polarity of which is the same as that of the charged toner in the developing agent, is impressed upon the discharging electrode 62 of the pre-transfer charger 60.

Consequently, the toner placed on the surface of the photoreceptor drum 10 is not attracted until recording paper P arrives at the transfer section 160, so that the quality of copy image can be improved.

High electric potential is impressed upon the discharging electrode 62 of the pre-transfer charger 60 in such a manner that: when the circumferential speed of the photoreceptor drum 10 is 140 mm/sec, the image width is 300 to 350 mm, and the paper thickness is 65 g/m$^2$, the charging current is controlled to 20 to 50 $\mu$A. At this moment, the component of electric current flowing to recording paper P is 10 to 20 $\mu$A in the case of high humidity and 5 to 10 $\mu$A in the case of low humidity.

High potential, the polarity of which is reverse to the charged toner, is impressed upon the transfer unit 16 under the condition of the constant current control so that a toner image can be transferred. Changeover control is conducted on the constant current control, for example, in the case of high humidity the current is controlled to be 350 $\mu$A and in the case low humidity the current is controlled to be 200 $\mu$A. As explained above, according to the variation of humidity, the recording paper is most influenced by humidity, the charging current is controlled in order to maintain the attraction force and the transfer efficiency in a constant range. Consequently, constant attraction and conveyance force, and high transfer efficiency can be obtained without being influenced by environmental conditions.

In this example, the apparatus is composed in the way explained above, so that the image forming apparatus can be provided which is characterized in that: a constant length of non-transfer area can be formed at the leading edge of a recording paper; the non-image area can be reduced to the minimum because it is not necessary to allow a margin in case there is caused a problem of malfunction; the transfer belt has high attraction and conveyance force when it conveys a recording paper; and the separability of a recording paper from an image carrier is high so that papering property is excellent.

Figure 21:
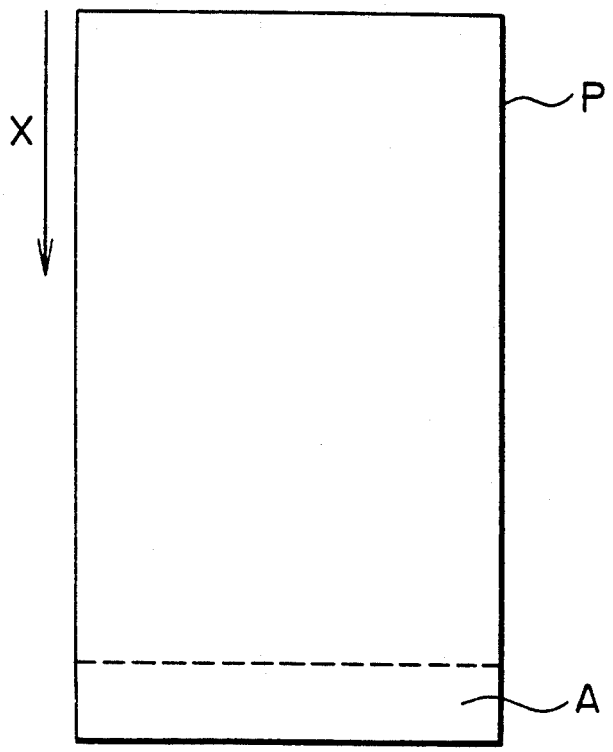
FIG. 21 is a schematic illustration which explains a non-image area on a transfer sheet in the transfer and conveyance apparatus of the present invention.
Figure 22:
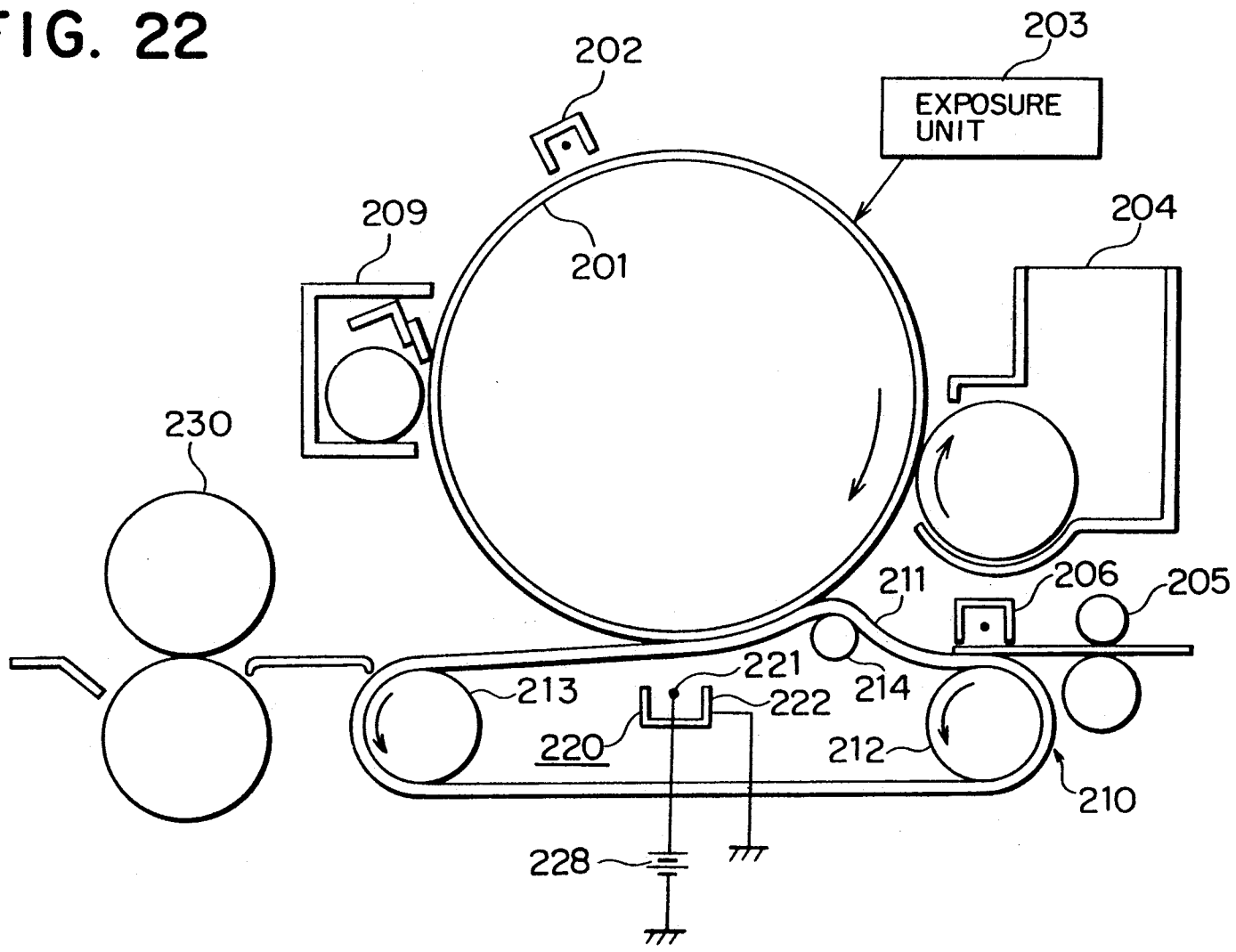
FIG. 22 is a schematic illustration which shows an example of the transfer and conveyance unit of the present invention.

FIG. 21 is a schematic illustration which shows the non-image area on a transfer paper of in the transfer and conveyance apparatus of the present invention. FIG. 22 is a schematic illustration of an example of the transfer and conveyance apparatus of the present invention.

In FIG. 21, transfer paper P is conveyed in the direction of arrow X. Area A indicates a specific area of the leading edge of recording paper P, and toner is not attracted to this area. The image area of recording paper P is defined as the area not included in the non-image area.

In FIG. 22, the transfer and conveyance unit 210 comprises the transfer belt 211, the pre-transfer charger 206, and the transfer unit 220. The transfer belt unit 210 is composed in such a manner that: the belt 211 is stretched between the roller 212 and the roller 213, both of which rollers are made from conductive material such as metal; and the belt 211 is pressed against the image forming drum 201 by the press roller 214. The above-described roller 212 is grounded. The resistance of the belt 211 is $10^{10}\Omega$cm.

The pre-transfer charger 206 is located being opposed to the roller 212 via the belt 211. The transfer unit 20 is located being opposed to the image forming drum 201.

The transfer unit 220 is provided with: the corona discharging electrode 221 which is opposed to the image forming drum 201 via the insulating belt 211; the opening for use in discharging; the grounded shield member 222 which is electrically insulated from the electrode 221; and the power source 228 which impresses high potential upon the corona discharging electrode 221. In the composition described above, the toner is attracted onto recording paper P in such a manner that: high potential of the polarity reverse to that of the toner is impressed upon the corona discharging electrode 221; and corona discharge is given to the insulating belt 211 so that an electric field can be generated on the circumferential surface of the image forming drum 201 and the insulating belt.

A discharger (not illustrated in the drawing) to remove electric charge form the belt 211 and a cleaning unit (not illustrated in the drawing) to remove dust and residual toner from the belt 211 may be provided to the apparatus.

The working action of the transfer and conveyance unit 210 composed in the way described above, will be explained as follows.

First of all, the circumferential surface of the image forming drum 201 is uniformly charged by the charger 202. After that, a latent image is formed on the circumferential surface of the image forming drum 201 by the exposure unit. Then the latent image is developed to a toner image by the developing unit 204. Transfer paper P is conveyed by the register roller 205 and inserted between the pre-transfer charger 206 and the grounded roller 212 via the insulating belt 211. Transfer paper P is given electric charge by the pre-transfer charger 206 so that it can be electrostatically attracted to the belt. At this moment, electric charge is given by the pre-transfer charger 206 to recording paper P in the range from the leading edge to the portion enough to obtain stable separability of recording paper.

Transfer paper P is conveyed by the conveyance belt 210 being electrostatically attracted by the belt, then recording paper P is pressed against the image forming drum 1 by the press roller 214. After that, recording paper is conveyed to the transfer unit 220.

After non-image area A of a transfer paper has passed through the transfer unit 220, the transfer unit 220 starts discharging and the toner image on the image forming drum is attracted to the image forming area of transfer paper P. Specifically, high potential of reverse polarity to the toner is impressed upon the corona discharging electrode 221 of the transfer unit 221 so that corona discharge is given to the belt 211, and an electric field is generated on the surface of the image forming drum 1 and the surface of the insulating belt. In the way explained above, the toner is attracted to transfer paper P. In this case, non-image area A of recording paper P passes through the transfer unit 220 while it does not conduct discharging, so that the electrostatic force between the non-image area A and the belt 211 is not decreased. Consequently, transfer paper P can be positively separated from the circumferential surface of the image forming drum 201.

As explained above, according to the transfer and conveyance unit 210 of this example, a part of the leading edge portion of transfer paper P is charged by the pre-transfer charger 206 without being influenced by environmental factors such as humidity so that transfer paper P can be electrostatically attracted to the belt, and corona discharge is not conducted on the non-image area by the transfer unit 220. Consequently, the separability of transfer paper P from the image forming drum 201 is excellent.

As explained above, the following effects can be achieved by the transfer and conveyance unit of the present invention comprising: a conveyance belt which is stretched between a pair of rollers, at least one of which is grounded; a pre-transfer charger which is opposed to the above-described grounded roller; and a transfer unit which is opposed to an image forming drum via the above-described belt. The effects are as follows. A certain length of leading edge portion is charged by the above-described pre-transfer charger. After the above-described non-image area of the transfer paper has passed through the above-described transfer unit, the image area of the transfer paper is charged by the transfer unit. Accordingly, the transfer paper can be positively separated from the image forming drum, and further the generation of ozone and the fluctuation of discharge due to the stain of a wire can be avoided.

Figure 23:
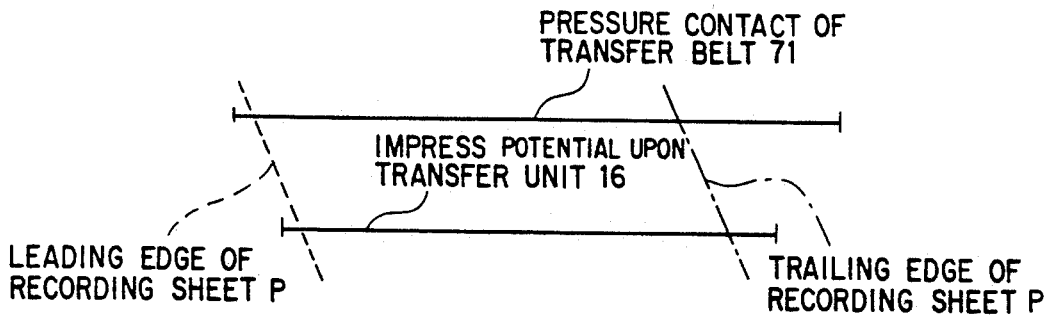
FIG. 23 and FIG. 24 are a partially enlarged time charts which show the relation between the contact of the transfer belt and impressing of electric potential.
Figure 24:
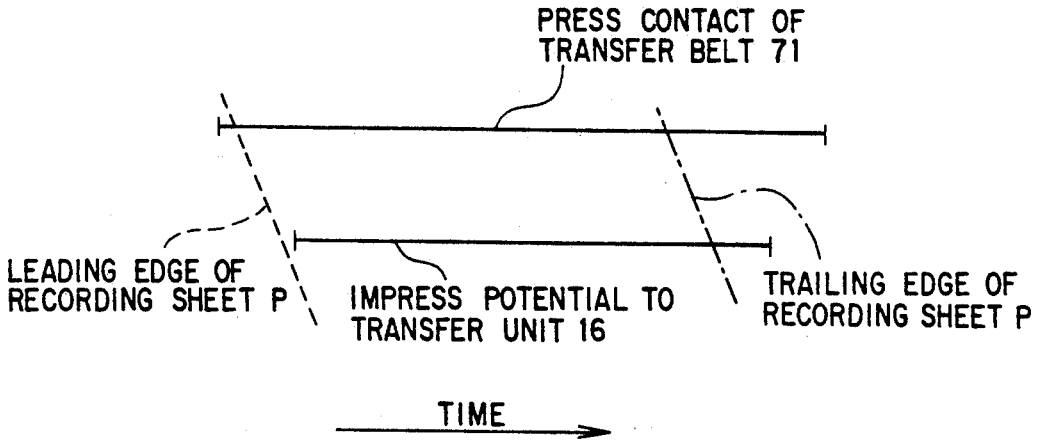

Referring now to FIG. 23 and FIG. 24, a variation of the example shown in FIG. 1 will be explained as follows.

Recording paper P is conveyed to the transfer unit 16 illustrated in FIG. 1 according to the time charts shown in Fig. 23 and FIG. 24. When the leading edge portion of recording paper P has passed through the transfer unit, potential of the polarity reverse to the charged toner is impressed upon the transfer unit under the constant current control so that the toner image can be transferred. Changeover control is conducted on the constant current control, for example, in the case of high humidity the current is controlled to be 350 $\mu$A and in the case of low humidity the current is controlled to be 200 $\mu$A. As explained above, according to the variation of humidity, the recording paper is most influenced by humidity, the charging current is controlled in order to maintain the attraction force and the transfer efficiency in a constant range. Consequently, constant attraction and conveyance force, and high transfer efficiency can be maintained.

Potential is impressed upon the transfer unit 16 as illustrated in FIG. 24. In this case image forming operation is conducted as follows. The starting time of image scanning or the staring time of printer writing is a little delayed compared with the normal operation so that a non-image area can be formed at the leading edge portion of recording paper P. While the above-mentioned non-image area is passing through the transfer unit 160, potential is impressed upon the transfer unit 160 for transfer. When the image forming portion on recording paper P has arrived at the transfer location 160, the transfer unit has sufficient transferability, so that the leading edge portion of an image can be positively and clearly copied.

As illustrated in FIG. 24, before the transfer belt 71 is released from the circumferential surface of the photoreceptor drum 10, the impression of potential upon the transfer unit 16 is stopped, so that corona discharge is stopped. Consequently, there is no electric charge on the transfer belt when it is released form the photoreceptor drum surface. As a result, sparks which are likely to occur when the transfer belt is released, can be prevented, so that there is no fear that the photoreceptor is damaged. In this example, the impression of potential upon the transfer unit is not necessarily stopped completely. The discharging current may be controlled to the minimum value so that sparks can not be caused.

Instead of stopping the impression of potential, a shutter may be provided to the opening of the transfer unit 16 and the shutter can be closed when the discharge to the transfer belt 71 needs to be stopped.

The composition of the transfer belt 71 which is used as a transfer means, is as follows: for example, the transfer belt 71 is composed of two layers; the main body of the transfer belt is made of an endless belt of 0.5 to 1 mm thick, a high resistance sheet is used, the resistance of which is $10^{10}\Omega$ cm, and the material of the sheet is silicon rubber, polyurethane rubber or butyl rubber; and the upper layer of the sheet is coated with fluorine contained resin by the method of spray-coating, so that the frictional resistance can be reduced.

After an image has been transferred, the circumferential surface of the photoreceptor drum 10 is cleaned by the cleaning unit 90 which is provided with the cleaning blade 91 and the toner recovery roller 92 which electrostatically recovers the residual toner. While a toner image is being formed on the circumferential surface of the photoreceptor drum 10, the above-mentioned cleaning blade 91 is withdrawn, and after the formed image has been transferred onto a recording paper, the cleaning blade 91 comes into contact with the photoreceptor drum 10 so that the surface of the photoreceptor drum can be cleaned. The discharge lamp 93 is located at the upstream of the cleaning unit 90 and the discharge lamp 94 is located at the downstream. The discharge lamp 93 discharges the residual toner on the photoreceptor drum 10 so that it can be easily removed, and the discharge lamp 94 discharges the cleaned surface of photoreceptor drum 10 so that the surface can be uniformly charged later. Further, the toner conveyance pipe 95 having a toner conveyance screw made from flexible material is provided to the bottom portion of the cleaning unit 90 so that the waste toner recovered by the cleaning unit can be conveyed to a toner recovery box not shown in the drawing. After the above-described cleaning process has been completed, the photoreceptor drum goes into the subsequent image forming process.

In the above-described color image forming apparatus, the structure of which is illustrated in FIG. 1, image forming means are provided around the photoreceptor drum 10 as illustrated in FIG. 4, and color images are formed being controlled by the control unit provided to the apparatus body as shown by the time chart in FIG. 5.

In accordance with the present invention, the details of which have been described above, there is provided an image forming apparatus in which sparks can be prevented when the transfer belt is released from the photoreceptor drum so that the life time of an image carrier can be extended.

What is claimed is:

1. An image forming apparatus comprising:

a rotatable image carrying member having a peripheral surface;

an image former for forming a toner image on said peripheral surface;

a conveyor, provided with a conveyor belt stretched between an inlet roller and an outlet roller, for conveying a recording sheet in a conveying direction through a transfer location, said conveyor belt adapted to contact and be retracted from said peripheral surface at said transfer location;

a precharger located over said inlet roller, said precharger forming a charging zone between said precharger and said inlet roller for charging said recording sheet with an electric charge to attract said recording sheet to said conveyor belt;

a transferrer for transferring said toner image from said peripheral surface onto said recording sheet at said transfer location by charging said conveyor belt with an electric charge to attract said toner image to said recording sheet; and a controller for controlling a start and step of said precharger and said transferrer, wherein said precharger charges a predetermined length of said recording sheet starting from said leading edge.

2. The image forming apparatus of claim 1 wherein said predetermined length is less than a total length of said recording sheet.

3. The image forming apparatus of claim 1 wherein said transferrer comprises:

a transfer roller, located on the rear side of said conveyor belt, for pressing said conveyor belt to said peripheral surface; and a potential source for intermittently applying an electric potential to said transfer roller, said potential source transmitting said toner image from said peripheral surface onto said recording sheet by said application of said electric potential.

4. The image forming apparatus of claim 1 further comprising:

a guide member for guiding said recording sheet so as to make the leading edge of said recording sheet contact said conveyor belt before said recording sheet enters into said charging zone formed by said precharger.

5. The image forming apparatus of claim 1 further comprising:

a detecting sensor, located on the upstream of said precharger, for detecting the leading edge of said recording sheet.

6. An image forming apparatus comprising:

a rotatable image carrying member having a peripheral surface;

an image former for forming a toner image on said peripheral surface;

a conveyor, provided with a conveyor belt stretched between an inlet roller and an outlet roller, for conveying a recording sheet in a conveying direction through a transfer location, said conveyor belt adapted to contact and be retracted from said peripheral surface at said transfer location;

a precharger located over said inlet roller, said precharger forming a charging zone between said precharger and said inlet roller for charging said recording sheet with an electric charge to attract said recording sheet to said conveyor belt;

a transferrer for transferring said toner image from said peripheral surface onto said recording sheet at said transfer location by charging said conveyor belt with an electric charge to attract said toner image to said recording sheet; and a controller for controlling a start and stop of said precharger and said transferrer, wherein said precharger charges a predetermined length of said recording sheet starting from a leading edge of said recording sheet and said transferrer starts to charge after said leading edge has passed said transfer location.

7. The image forming apparatus of claim 6 wherein said conveyor belt is adapted to be separated from said peripheral surface of said image carrying member during a developing time period of said toner image on said peripheral surface, and further wherein said controller controls said transferrer to stop charging before said conveyor belt is separated from said peripheral surface.

* * * * *